US011597992B2

(12) United States Patent
Hayashi et al.

(10) Patent No.: US 11,597,992 B2
(45) Date of Patent: Mar. 7, 2023

(54) NI-BASED THERMAL SPRAYING ALLOY POWDER AND METHOD FOR MANUFACTURING ALLOY COATING

(71) Applicants: EBARA ENVIRONMENTAL PLANT CO., LTD., Tokyo (JP); DAI-ICHI HIGH FREQUENCY CO., LTD., Tokyo (JP)

(72) Inventors: Shigenari Hayashi, Tokyo (JP); Mohammad Emami, Tokyo (JP); Manabu Noguchi, Tokyo (JP); Eiji Ishikawa, Tokyo (JP); Eichi Tanaka, Tokyo (JP); Nobuhiro Takasaki, Tokyo (JP); Takashi Kogin, Tokyo (JP)

(73) Assignees: EBARA ENVIRONMENTAL PLANT CO., LTD, Tokyo (JP); DAI-ICHI HIGH FREQUENCY CO., LTD., Tokyo (JP)

( * ) Notice: Subject to any disclaimer, the term of this patent is extended or adjusted under 35 U.S.C. 154(b) by 0 days.

(21) Appl. No.: 16/485,942

(22) PCT Filed: Feb. 8, 2018

(86) PCT No.: PCT/JP2018/004293
§ 371 (c)(1),
(2) Date: Aug. 14, 2019

(87) PCT Pub. No.: WO2018/150984
PCT Pub. Date: Aug. 23, 2018

(65) Prior Publication Data

US 2020/0017949 A1 Jan. 16, 2020

(30) Foreign Application Priority Data

Feb. 14, 2017 (JP) ..... JP2017-024792

(51) Int. Cl.
*C22C 19/05* (2006.01)
*C23C 4/08* (2016.01)
(Continued)

(52) U.S. Cl.
CPC ..... *C23C 4/08* (2013.01); *C22C 19/055* (2013.01); *C22C 19/056* (2013.01); *C23C 4/067* (2016.01); *C23C 4/18* (2013.01)

(58) Field of Classification Search
None
See application file for complete search history.

(56) References Cited

U.S. PATENT DOCUMENTS 4,031,278 A * 6/1977 Patel ..... B05B 7/205 427/452
4,198,234 A * 4/1980 Cadle ..... B22F 1/00 419/10
(Continued)

FOREIGN PATENT DOCUMENTS

CN 104385703 A 3/2015
CN 104711506 A 6/2015
(Continued)

OTHER PUBLICATIONS

ASM Handbook, vol. 2: Properties and Selection: Nonferrous Alloys and Special-Purpose Materials, "Preparation and Characterization of Pure Metals", ASM International, 1990, pp. 1093-1097.*
(Continued)

*Primary Examiner* — George Wyszomierski
(74) *Attorney, Agent, or Firm* — BakerHostetler

(57) ABSTRACT

There are provided a Ni-based thermal spraying alloy powder having excellent corrosion resistance and erosion-corrosion resistance even in an environment in which corrosion acts or corrosion and erosion act simultaneously, and a method for manufacturing an alloy coating. A Ni-based
(Continued)

thermal spraying alloy powder comprising Cr: 15 wt % or more and 25 wt % or less, Mo: 0 wt % or more and 5 wt % or less, Si: 0.5 wt % or more and less than 2 wt %, Fe: 5 wt % or less, C: 0.3 wt % or more and 0.7 wt % or less, and B: 4 wt % or more and 7 wt % or less, with the balance being Ni and incidental impurities.

7 Claims, 5 Drawing Sheets

(51) Int. Cl.
*C23C 4/18* (2006.01)
*C23C 4/067* (2016.01)

(56) References Cited

U.S. PATENT DOCUMENTS

| | | | |
|---|---|---|---|
| 4,500,489 | A | 2/1985 | Nicoll |
| 4,594,103 | A | 6/1986 | Simm et al. |
| 2016/0245295 | A1* | 8/2016 | Xu ..... C22C 19/05 |

FOREIGN PATENT DOCUMENTS

| | | | |
|---|---|---|---|
| GB | 2023175 | A | 12/1979 |
| JP | 54-139821 | A | 10/1979 |
| JP | H10-060618 | A | 3/1998 |
| JP | 2000-119781 | A | 4/2000 |
| JP | 2006-161132 | A | 6/2006 |
| JP | 2006-265591 | A | 10/2006 |
| JP | 2015-143372 | A | 8/2015 |

OTHER PUBLICATIONS

International Patent Application No. PCT/JP2018/004293; Int'l Search Report; dated Apr. 3, 2018; one page.
European Patent Application No. 18754805.2; Extended Search Report; dated Aug. 28, 2020; 5 pages.
Masahiko Morinaga; "Atomization Energy Expression of the Chemical Bond between Atoms in 3d Transition Metal Compounds"; Toyota Research Report No. 68; 2015; p. 35-47 (contains English Abstract).

* cited by examiner

METAL LOSS; 16.5 μm/250 hours (a) SALT CONCENTRATION: 1.0 wt%

METAL LOSS; 27.4 μm/250 hours (b) SALT CONCENTRATION: 0.5 wt%

NI-BASED THERMAL SPRAYING ALLOY POWDER AND METHOD FOR MANUFACTURING ALLOY COATING

TECHNICAL FIELD

The present invention relates to a Ni-based thermal spraying alloy powder and a method for manufacturing alloy coating, and particularly to a Ni-based thermal spraying alloy powder that can form an alloy coating excellent in environment resistance in a high temperature environment where corrosion and erosion-corrosion are problems, and a method for manufacturing the alloy coating.

BACKGROUND ART

In an incinerator such as a waste or biomass incinerator, a harsh high temperature corrosion environment is formed with chlorine contained in the fuel. Particularly, on the surface of a heat exchanger having a temperature lower than atmosphere temperature, chlorides contained in the atmosphere are concentrated and deposited, and therefore severe corrosion occurs. Further, in the case of a fluidized bed type boiler, severe metal loss may occur due to the action of erosion by the bed material, in addition to corrosion. As a metal loss measure for these, a protector is mounted. The mounting of a protector is effective, but causes a decrease in heat transfer efficiency in a heat exchanger. Therefore, as a metal loss measure, surface treatment such as thermal spraying is often used.

Examples of general problems of thermally sprayed coatings include the adhesive force between the pores in the coating and a substrate. HVOF (High Velocity Oxygen Fuel) thermal spraying in which the particle rate during thermal spraying is made faster, and the like can reduce porosity compared with plasma spraying. However, the pores cannot be completely eliminated, and the coating is also only physically joined to the substrate. Therefore, a self-fluxing alloy thermal spraying method is used in which after thermal spraying, a coating is remelted, thereby being able to form a metallurgical reaction layer with a substrate and eliminate the pores in the thermally sprayed coating, which significantly improves the properties of the thermally sprayed coating. The self-fluxing alloy thermal spraying is known to provide excellent corrosion resistance because the pores in the coating decrease by remelting treatment, and the intrusion of corrosive substances can be suppressed. However, the composition of the self-fluxing alloy powder that can be used for the self-fluxing alloy thermal spraying is limited. The self-fluxing alloy is required to have a melting point at 1,000° C. or less and have a wide temperature range between the liquidus and the solidus. When the melting point is too high, not only is melting difficult, but the heat influence of increasing the temperature to melting temperature on the matrix is feared. On the other hand, when the temperature range is narrow, temperature control during remelting treatment is difficult, and a good quality coating is less likely to form.

The most generally used self-fluxing alloy powder is SFNi4 (214A NiCrCuMoBSi 69 15 3 3A) defined in JIS H8303: 2010. SFNi4 is a Ni—Cr alloy consisting of Cr: 12 wt % or more and 17 wt % or less, Mo: 4 wt % or less, Si: 3.5 wt % or more and 5.0 wt % or less, Fe: 5 wt % or less, C: 0.4 wt % or more and 0.9 wt % or less, B: 2.5 wt % or more and 4.0 wt % or less, Co: 1 wt % or less, and Cu: 4 wt % or less, and the balance being Ni, and is an alloy having corrosion resistance in a wide range of environments and having a high hardness of 50 to 60 in terms of HRC and therefore being excellent in corrosion resistance and erosion resistance. SFNi4 is also excellent in workability (remelting treatment) and therefore is used in a wide range of fields. For particular applications, alloys obtained by improving SFNi4, and the like are also proposed.

For example, there are proposed a Ni-based self-fluxing alloy powder having suppressed molten metal flowability during remelting treatment which comprises Cr: 10 wt % to 16.5 wt %, Mo: 4.0 wt % or less, Si: 3.0 wt % to 5.0 wt %, Fe: 15.0 wt % or less, C: 0.01 wt % to 0.9 wt %, B: 2.0 wt % to 4.0 wt %, Cu: 3.0 wt % or less, and O: 50 ppm to 500 ppm, with the balance of Ni and incidental impurities, and satisfies Si/B: 1.2 to 1.7, and a part excellent in corrosion resistance and/or erosion resistance having a coating formed from this Ni-based self-fluxing alloy powder by a thermal spraying method (PTL1).

In addition, there is proposed a Ni-based self-fluxing alloy powder comprising Cr: 12 wt % to 17 wt %, Mo: 3 wt % to 8 wt %, Si: 3.5 wt % to 5.0 wt %, Fe: 5.0 wt % or less, C: 0.4 wt % to 0.9 wt %, B: 2.5 wt % to 4.0 wt %, Cu: 4.0 wt % or less, and O: 200 ppm or less, with the balance of Ni and incidental impurities, and satisfying 0 ppm≥−20 Mo %+100 (PTL2).

Further, there is proposed a Ni-based self-fluxing alloy powder for thermal spraying comprising Cr: 30.0 wt % to 42.0 wt %, Mo: 0.5 wt % to 2.0 wt %, Si: 2.0 wt % to 4.0 wt %, Fe: 5.0 wt % or less, C: 2.5 wt % to 4.5 wt %, and B: 1.5 wt % to 4.0 wt %, with the balance being Ni and incidental impurities (PTL3). It is disclosed that this Ni-based self-fluxing alloy powder for thermal spraying is made by an atomization method, chromium carbide having a particle diameter of 5 μm or less is uniformly precipitated in the interior of the particles, and the high temperature erosion properties improve.

Further, there is proposed a corrosion-resistant-erosion-resistant heat transfer tube for heat exchange having formed thereon a protective coating comprising a Ni-based self-fluxing alloy comprising Cr: 12 wt % to 17 wt %, Mo: 4 wt % or less, Si: 3.5 wt % to 5.0 wt %, Fe: 5.0 wt % or less, C: 0.4 wt % to 0.9 wt %, B: 2.5 wt % to 4.5 wt %, and Cu: 4.0 wt % or less, with the balance being Ni and incidental impurities (PTL4).

However, it cannot be deemed that the conventional Ni-based self-fluxing alloys have sufficient environment resistance against erosion-corrosion in which corrosion and erosion occur simultaneously.

CITATION LIST

Patent Literature

PTL1: Japanese Patent Laid-Open No. 2015-143372
PTL2: Japanese Patent Laid-Open No. 2006-265591
PTL3: Japanese Patent Laid-Open No. 2006-161132
PTL4: Japanese Patent Laid-Open No. 2000-119781

SUMMARY OF INVENTION

Technical Problem

It is an object of the present invention to provide a Ni-based thermal spraying alloy powder having excellent corrosion resistance and erosion-corrosion resistance even in an environment in which corrosion acts or corrosion and erosion act simultaneously, and a method for manufacturing an alloy coating.

Solution to Problem

The present inventors have studied diligently in order to solve the above problem, and as a result paid attention to the optimization of the content of Si and B in a Ni-based alloy and completed the present invention.

Embodiments of the present invention are as follows.

[1] A Ni-based thermal spraying alloy powder comprising Cr: 15 wt % or more and 25 wt % or less, Mo: 0 wt % or more and 5 wt % or less, Si: 0.5 wt % or more and less than 2.0 wt %, Fe: 5 wt % or less, C: 0.3 wt % or more and 0.7 wt % or less, and B: 4 wt % or more and 7 wt % or less, with the balance being Ni and incidental impurities.

[2] The Ni-based thermal spraying alloy powder according to [1], wherein a content of Si and B satisfies $-0.25\ B\ (wt\ \%)+1.75 \leq Si\ (wt\ \%) \leq -0.25\ B\ (wt\ \%)+2.75$.

[3] The Ni-based thermal spraying alloy powder according to [1], comprising Mo: 0 wt % or more and 1 wt % or less.

[4] The Ni-based thermal spraying alloy powder according to [1], comprising Mo: 1 wt % or more and 5 wt % or less.

[5] A method for manufacturing an alloy coating comprising thermally spraying the Ni-based thermal spraying alloy powder according to any one of [1] to [4] onto a substrate to form an alloy coating, and remelting the alloy coating to reduce porosity in the alloy coating and improve adhesiveness between the alloy coating and the substrate.

[6] The method for manufacturing an alloy coating according to [5], wherein the remelting is performed by high frequency induction heating.

Advantageous Effects of Invention

The Ni-based thermal spraying alloy powder of the present invention can form an alloy coating that allows the life extension of a heat transfer tube and the like, even in a harsh corrosion environment or erosion-corrosion environment at high temperature involving chlorides, such as a waste or biomass incinerator or a boiler, without significantly impairing the heat transfer efficiency of a heat exchanger like a protector. As a result, it is possible to provide an incinerator or a boiler in which the heat exchange efficiency of a heat transfer tube is not decreased, and the apparatus operating rate is increased due to the life extension of members.

DESCRIPTION OF EMBODIMENTS

Figure 1:
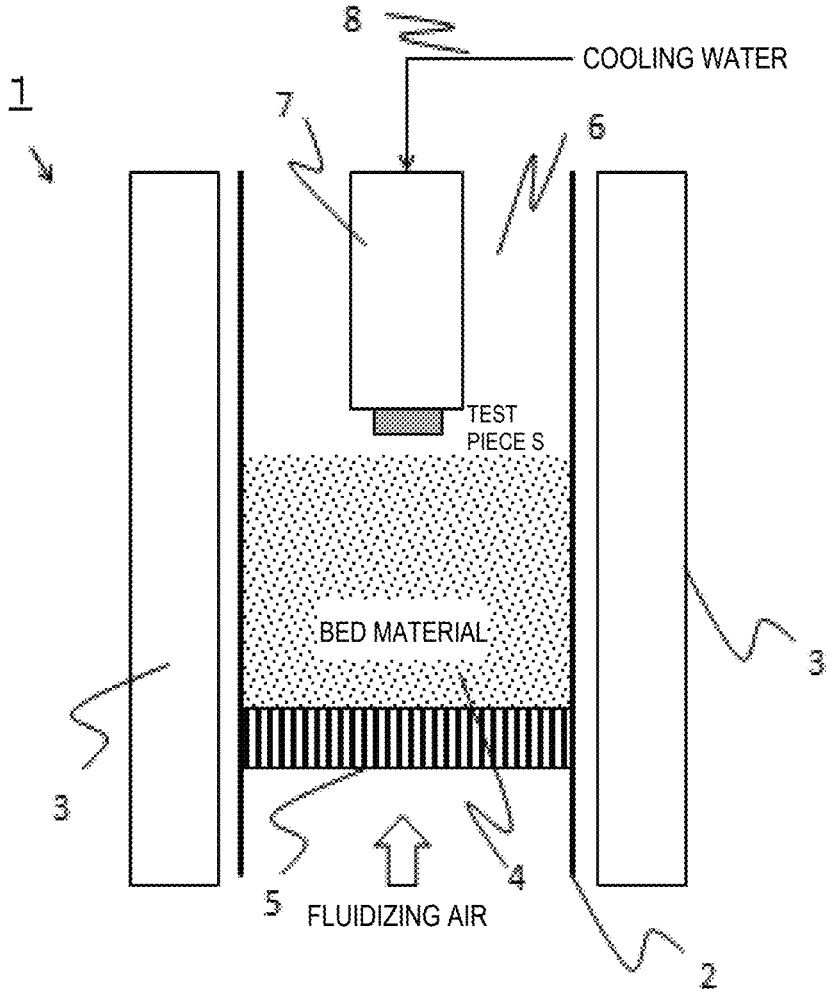
FIG. 1 is a schematic explanatory diagram of an erosion-corrosion test apparatus using a small fluidized bed.

The Ni-based thermal spraying alloy powder of the present invention comprises Cr: 15 wt % or more and 25 wt % or less, Mo: 0 wt % or more and 5 wt % or less, Si: 0.5 wt % or more and less than 2.0 wt %, Fe: 5 wt % or less, C: 0.3 wt % or more and 0.7 wt % or less, and B: 4 wt % or more and 7 wt % or less, with the balance being Ni and incidental impurities. The content of Si and B preferably satisfies $-0.25\ B\ (wt\ \%)+1.75 \leq Si\ (wt\ \%) \leq -0.25\ B\ (wt\ \%)+2.75$. The composition of the Ni-based thermal spraying alloy powder of the present invention will be described element by element below.

[Cr: 15 wt % or more and 25 wt % or less]

The Ni-based thermal spraying alloy powder of the present invention comprises Cr: 15 wt % or more and 25 wt % or less, preferably 18 wt % or more and 22 wt % or less. Cr is an essential element for maintaining corrosion resistance at high temperature, and when the content of Cr is less than 15 wt %, sufficient corrosion resistance cannot be exhibited. On the other hand, when the content is increased, the corrosion resistance improves, but when the content exceeds 25 wt %, the erosion-corrosion resistance decreases, and the melting point of the alloy increases, and therefore remelting treatment is difficult.

[Mo: 0 wt % or more and 5 wt % or less]

The Ni-based thermal spraying alloy powder of the present invention comprises Mo: 0 wt % or more and 5 wt % or less. Alloy 625 containing 9 wt % of Mo is known to exhibit excellent corrosion resistance in a chloride corrosion environment typified by a garbage incinerator. However, as a result of carrying out a corrosion test described later, it has been found that in the Ni-based alloy of the present invention, when Mo is added to 7 wt %, the corrosion resistance conversely decreases. On the other hand, for the erosion-corrosion resistance, the result has been that when the content is decreased, the metal loss is reduced though slightly. When the erosion-corrosion resistance is regarded as important, the Mo content is preferably reduced to 0 wt % or more and 1 wt % or less. When the corrosion resistance is regarded as important, the Mo content is preferably 1 wt % or more and 5 wt % or less.

[C: 0.3 wt % or more and 0.7 wt % or less]

The Ni-based thermal spraying alloy powder of the present invention comprises C: 0.3 wt % or more and 0.7 wt % or less. C is generally used to form hard Cr carbide and the like to improve the hardness of a thermally sprayed coating. Precipitated phases, mainly carbides, protrude to alleviate erosion suffered by the Ni matrix and thereby contribute to the improvement of the erosion-corrosion resistance. When the content of C is less than 0.3 wt %, carbide phases are insufficient. However, when the content of C exceeds 0.7 wt %, Cr in the matrix is consumed as a carbide, and the corrosion resistance decreases.

[Fe: 5 wt % or less]

The Ni-based thermal spraying alloy powder of the present invention comprises Fe: 5 wt % or less. Fe dissolves in the Ni matrix to improve the strength of the Ni matrix. However, Fe is poor in corrosion resistance, particularly chloride corrosion resistance, at high temperature compared with Ni, and therefore excessive addition leads to a decrease in corrosion resistance. The addition of 5 wt % or less of Fe does not adversely affect the corrosion resistance and the erosion-corrosion resistance.

[B: 4 wt % or more and 7 wt % or less]

The Ni-based thermal spraying alloy powder of the present invention comprises B: 4 wt % or more and 7 wt % or less, preferably 5 wt % or more and 6 wt % or less. B is an element essential for workability (remelting properties), and forms borides in the alloy to contribute to the hardening of the Ni matrix. It is considered that precipitated phases poor in corrosion resistance are preferentially corroded, and the corrosion products grow and protrude, and thereby preferentially suffer the collision of a bed material, and as a result alleviate erosion conditions suffered by the Ni matrix and reduce the metal loss. As a result of an erosion-corrosion test described later, it has been found that when the content of B exceeds 7 wt %, the corrosion resistance decreases significantly.

[Si: 0.5 wt % or more and less than 2.0 wt %]

The Ni-based thermal spraying alloy powder of the present invention comprises Si: 0.5 wt % or more and less than 2.0 wt %, preferably Si: 0.5 wt % or more and less than 1.5 wt %. Si is known to be easily bonded to oxygen to form $SiO_2$, and consume oxygen in an environment, and therefore contribute to corrosion resistance improvement. As a result of a corrosion test and an erosion-corrosion resistance test described later, it has been found that when the amount of Si added is increased, the corrosion resistance improves, but the metal loss increases, and the erosion resistance decreases. In addition, it has been found that when the content of Si is set less than 0.5 wt %, the workability (remelting treatment) is poor, and remelting is not sufficiently performed, and a sufficiently dense coating cannot be formed.

[$-0.25$ B (wt %)$+1.75 \leq$Si (wt %)$\leq -0.25$ B (wt %)$+2.75$]

In the Ni-based thermal spraying alloy powder of the present invention, in addition to the above composition, the content of Si and B satisfies $-0.25$ B (wt %)$+1.75$ Si (wt %)$\leq -0.25$ B (wt %)$+2.75$. In order to improve the erosion resistance, the content of Si is preferably decreased, but Si is an element essential for the workability of a self-fluxing alloy coating because Si provides oxidation resistance and self-fluxing properties. As a result of a corrosion test and an erosion-corrosion property test described later, it has been found that remelting can be performed by increasing B even if Si is decreased under the condition that the content of Si and B satisfies $-0.25$ B (wt %)$+1.75$ Si (wt %)$\leq -0.25$ B (wt %)$+2.75$.

Next, the method for manufacturing the alloy coating of the present invention will be described.

The method for manufacturing the alloy coating of the present invention comprises thermally spraying the above Ni-based thermal spraying alloy powder onto a substrate to form an alloy coating, and remelting the alloy coating to reduce porosity in the alloy coating and improve the adhesiveness between the alloy coating and the substrate. The remelting is preferably performed by high frequency induction heating.

As the method of remelting treatment, typical methods such as burner heating and heat treatment using an electric furnace, and high frequency induction heating can be used without limitation. In the remelting treatment in the method for manufacturing the alloy coating of the present invention, heating is preferably performed from the substrate side, rather than heating from the coating surface side. When heating is performed from the coating surface side, impurities such as oxides captured during thermal spraying may remain in the interior of the thermally sprayed coating. When heating is performed from the substrate side, the impurities float on the surface side and can be removed from the interior of the coating, and therefore a thermally sprayed coating having good quality can be formed. As the method for performing heating from the substrate side, high frequency induction heating can be preferably used.

The substrate onto which the Ni-based thermal spraying alloy powder of the present invention is to be thermally sprayed is not particularly limited, and the Ni-based thermal spraying alloy powder can be applied to substrates such as metals that require a usual thermally sprayed coating. Particularly, when the Ni-based thermal spraying alloy powder is applied to heat transfer tubes and the like used in harsh erosion-corrosion environments, excellent erosion-corrosion resistance can be provided.

EXAMPLES

The configuration of a small fluidized bed test apparatus used in the present Examples is schematically described in FIG. 1.

A fluidized bed test apparatus 1 comprises a container 2 in which a fluidized bed 4 of a bed material is formed, and an electric furnace 3 provided on the outer periphery of the container 2. A glass filter 5 for holding the bed material and supplying fluidizing air is provided at the bottom of the container 2. A test piece holder (water-cooled copper block) 7 for holding a test piece S inside or above the fluidized bed 4 is provided in a test portion 6 in the upper portion of the container 2. A cooling water conduit 8 for supplying cooling water is connected to the test piece holder 7.

The test piece S was attached to the test piece holder 7 of the fluidized bed test apparatus 1, the atmosphere gas and the bed material in the container 2 were kept at 700° C. by external heating by the electric furnace 3, and the surface of the test piece S was cooled to 350° C. by indirect cooling with cooling water supplied to the test piece holder 7, providing a temperature gradient between the atmosphere and the test piece to reproduce the heat transfer tube environment of an actual machine. The flowing conditions of the fluidized bed 4 were changed by air supplied from below the fluidized bed 4, and further, chlorides were mixed into the bed material to reproduce a corrosive environment.

[Test 1]

Figure 2:
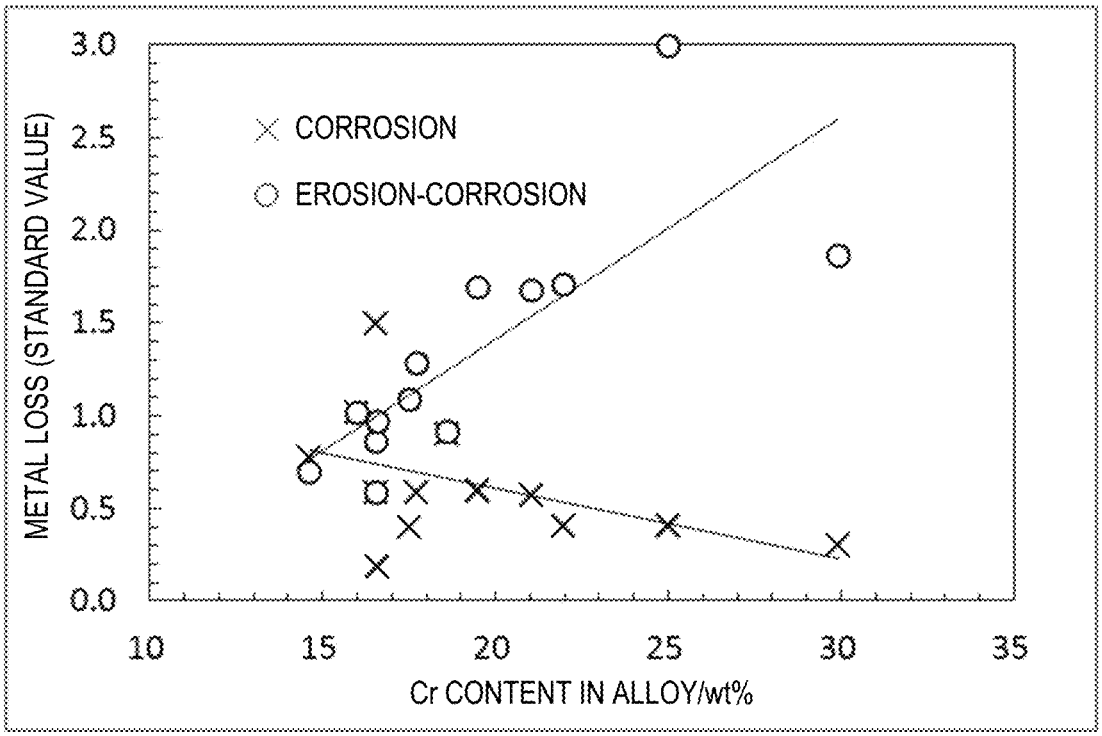
FIG. 2 is a graph summarizing the results of an erosion-corrosion test and a corrosion test using a small fluidized bed.

The metal loss properties of Ni-based alloys in a corrosion environment and an erosion-corrosion environment were examined using the fluidized bed test apparatus 1. FIG. 2 is a graph showing the results of placing the test piece S in two places, the interior of the layer where sand flows (erosion-corrosion environment), and a portion above the layer not affected by erosion by the sand (corrosion environment), in the presence of chlorides, and examining respective metal losses. As is clear from FIG. 2, it was found that as the Cr content in the alloy increased, the amount of corrosion decreased, and the corrosion resistance improved, but conversely the metal loss increased, and the erosion resistance decreased. Erosion resistance generally corresponds to material hardness, and therefore in order to have corrosion resistance together with erosion resistance, the material should be hard and excellent in corrosion resistance. However, from the results in FIG. 2, it became clear that in order to have erosion-corrosion resistance, material properties different from hardness (erosion resistance) and corrosion resistance were required.

[Test 2]

Figure 3:
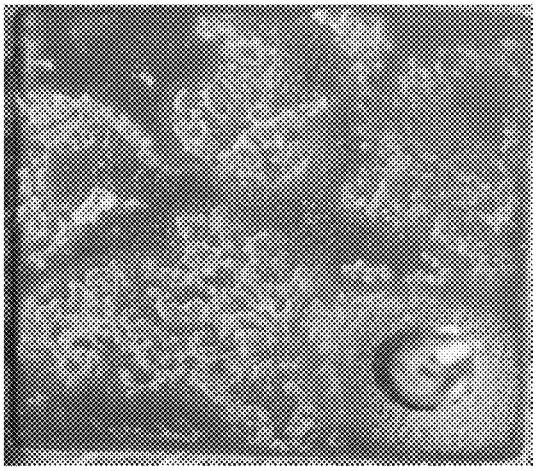
FIG. 3 shows photographs showing the forms of test piece surfaces after the erosion-corrosion test of a Ni-based thermal spraying alloy.
Figure 3:
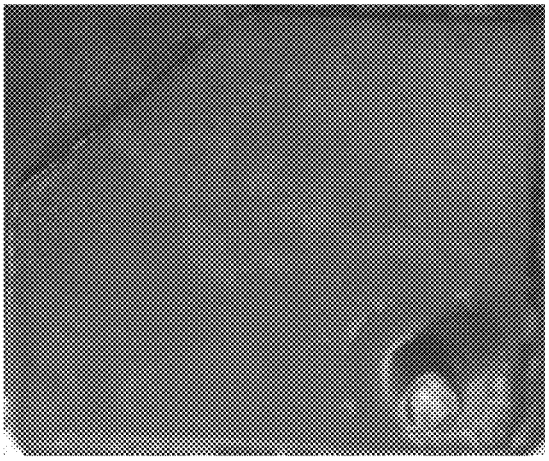

The states of the surfaces of Ni-based self-fluxing alloys after an erosion-corrosion test are shown in FIG. 3. The states are the results of performing the erosion-corrosion test under two conditions that the concentration of a salt added to a bed material was (a) 1.0 wt % and (b) 0.5 wt %. As the bed material, silica sand having an average particle diameter of 0.45 mm was used, and as the salt, a 25 wt % NaCl-25 wt % KCl-50 wt % $CaCl_2$ mixed salt was used. The amount of air supplied for forming a fluidized bed was 20 L/min, and the amount of air corresponding to a Umf ratio of 2 was flowed. As the amount of the salt added increases, the corrosion environment becomes harsh. The test piece surfaces after the test were observed. In the case of (a) a salt concentration of 1.0 wt %, the surface was covered with corrosion products, but in the case of (b) a salt concentration of 0.5 wt %, the surface was smooth, no clear corrosion products were observed, and the metal base was in a state close to an exposed state. The metal losses of both after 250 hours were compared. The metal loss was 16.5 μm at (a) a salt concentration of 1.0 wt % and 27.4 μm at (b) a salt concentration of 0.5 wt %, and the metal loss increased at a salt concentration of 0.5 wt %, a mild corrosion condition. This is considered as follows. When the corrosion environment is harsh, the growth rate of the corrosion products is fast, and the alloy surface is rapidly covered with the corrosion products to form a protective coating to suppress subsequent corrosion and erosion. On the other hand, when the corrosion environment is mild, the growth rate of the corrosion products is slow, and the produced corrosion products are damaged by erosion and therefore cannot form a protective coating, and corrosion continues to proceed at a fast rate. Also from this, it was confirmed that in order to have erosion-corrosion resistance, an important point was to rapidly form corrosion products capable of sufficiently suppressing corrosion and erosion, rather than simple corrosion resistance and erosion resistance.

[Test 3]

From these viewpoints, the influence of elements in Ni—Cr alloys having the various compositions shown in Table 1 was evaluated.

The erosion-corrosion test conditions were the same as test 2 except that the amount of air was 25 L/min (a Umf ratio of 2.5), and the salt concentration was 0.5 wt %. For the amount of erosion-corrosion (metal loss), test piece thickness before and after the test was measured using a laser thickness gauge, and the difference between the test piece thickness before the test and the test piece thickness after the test was obtained.

When use in an actual machine was considered, there was also an environment in which the erosion conditions were mild, and corrosion predominated, and an extreme decrease in corrosion resistance was not desired, and therefore corrosion test evaluation was also carried out together. A test piece was exposed to the upper portion of a crucible in which the NaCl—KCl—$CaCl_2$mixed salt was set, and corrosion behavior under chloride vapors was examined. The corrosion test was performed at 530° C., equal to or higher than the melting point of the mixed salt, for 400 hours, and the amount of weight decrease was measured and converted into that per $cm^2$ of the alloy surface area to obtain the amount of corrosion.

The results of the erosion-corrosion test and the corrosion test are shown together in Table 1.

TABLE 1

Results of Erosion-Corrosion Test and Corrosion Test

| Purpose | Alloy Number | Ni | Cr | Mo | Fe | Si | B | C | Cu | Amount of erosion-corrosion (μm) | Amount of corrosion ($mg/cm^2$) |
|---|---|---|---|---|---|---|---|---|---|---|---|
| Cr evaluation | No. 1 | Balance | 15 | 3 | | | | | | 20.2 | 0.880 |
| | No. 2 | Balance | 20 | 3 | | | | | | 18.4 | 0.163 |
| | No. 3 | Balance | 25 | 3 | | | | | | 38.6 | 0.142 |
| Mo evaluation | No. 4 | Balance | 20 | | | | | | | 18.6 | 0.766 |
| | No. 5 | Balance | 20 | 1 | | | | | | 19.2 | 0.382 |
| | No. 2 | Balance | 20 | 3 | | | | | | 21.6 | 0.163 |
| | No. 6 | Balance | 20 | 5 | | | | | | 23.2 | 0.102 |
| | No. 7 | Balance | 20 | 7 | | | | | | 32.8 | 0.440 |
| Si evaluation | No. 2 | Balance | 20 | 3 | | | | | | 18.4 | 0.163 |
| | No. 8 | Balance | 20 | 3 | | 2 | | | | 25.2 | 0.109 |
| | No. 9 | Balance | 20 | 3 | | 4 | | | | 46.4 | 0.054 |
| B evaluation | No. 10 | Balance | 20 | 3 | | 2 | 5 | | | 26.8 | 0.291 |
| | No. 11 | Balance | 20 | 3 | | 2 | 7.5 | | | 30.2 | 0.824 |
| C evaluation | No. 12 | Balance | 20 | 3 | | 2 | | 0.5 | | 24.0 | 0.168 |
| Fe evaluation | No. 13 | Balance | 20 | 3 | 4 | 2 | | | | 27.4 | 0.174 |
| Cu evaluation | No. 14 | Balance | 20 | 3 | | 2 | | | 4 | 76.5 | 0.162 |
| Conventional product | No. 15 | Balance | 15 | 3 | 4 | 4 | 3 | 0.5 | 4 | 48.4 | 0.387 |

*The content of each element is expressed in wt %.

Figure 4:
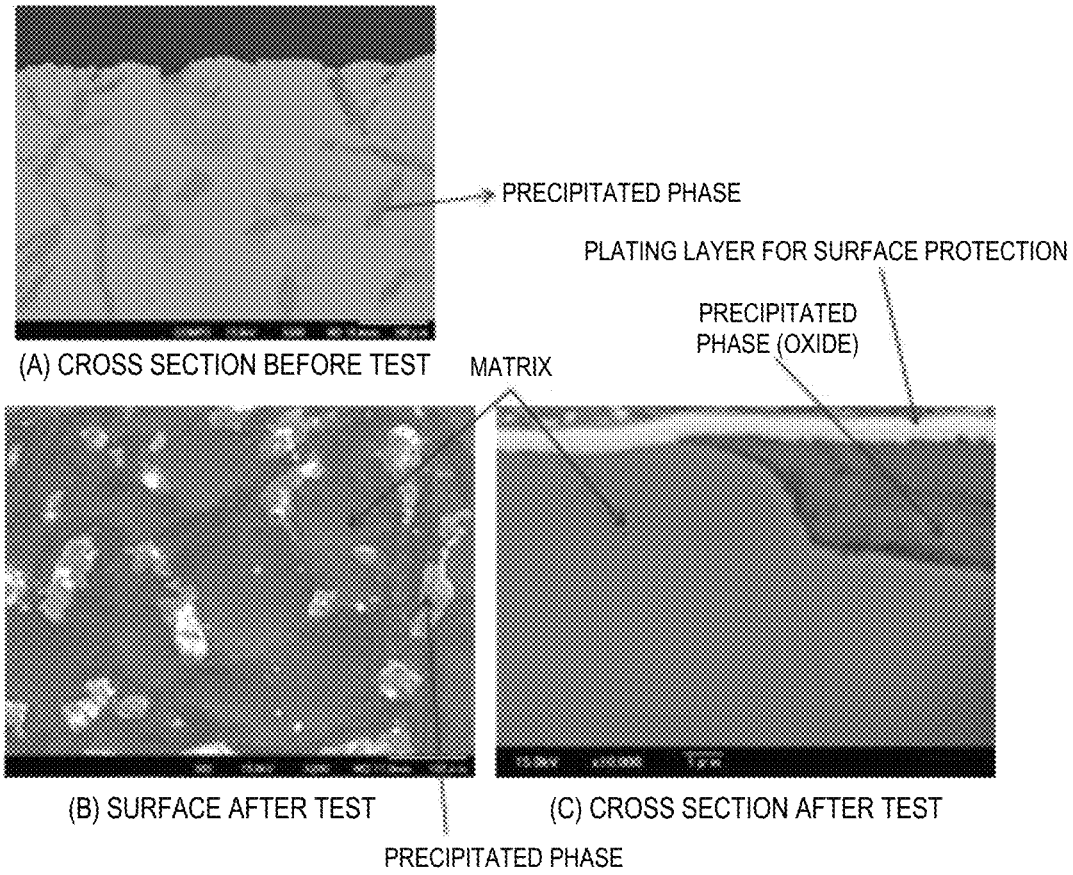
FIG. 4 shows SEM photographs of a Ni-based thermal spraying alloy test piece to which 5 wt % of B is added.

SEM photographs of the test piece of the No. 10 alloy shown in Table 1 are shown in FIG. 4. In FIG. 4, (A) shows a cross section of the alloy before the test (15.0 kV, 200x), (B) shows the surface of the test piece after the test (15.0 kV, 200x), and (C) shows a cross section of the test piece after the test subjected to plating for surface protection and then cut and polished (15.0 kV, 10000x). In the alloy structure before the test (A), a large number of precipitated phases are observed. From the surface (B) and the cross section (C) after the test, it can be confirmed that corrosion products grow in the portions of the precipitated phases present in the surface. In addition, as a result of the corrosion resistance test, for the test piece of the No. 10 alloy, a tendency to a fast corrosion rate was seen, but the amount of erosion-corrosion (metal loss) was relatively small, 26.8 μm. It is considered that the precipitated phases having poor corrosion resistance corrode preferentially, and the corrosion products grow, protrude on the matrix surface, and thereby preferentially collide with the bed material, and as a result alleviate erosion conditions suffered by the matrix, and the amount of erosion-corrosion (metal loss) is reduced.

[Test 4]

Figure 5:
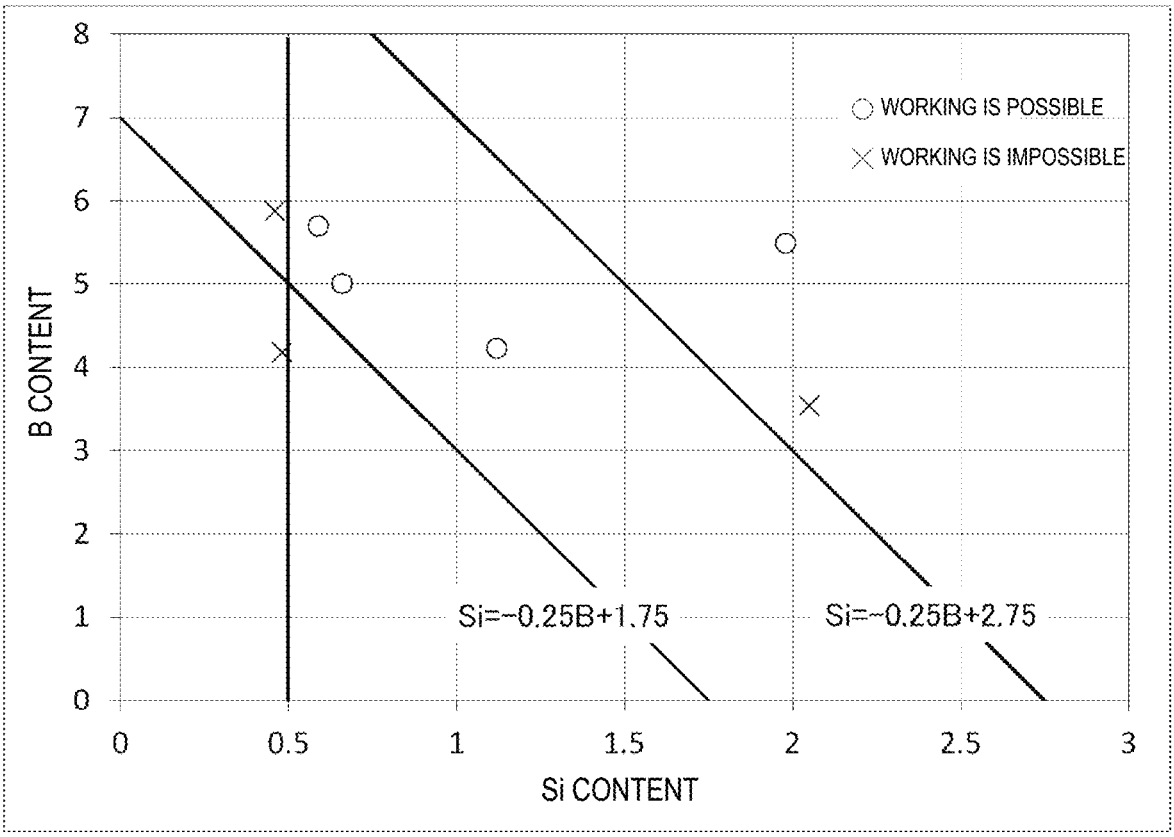
FIG. 5 is a graph showing the relationship of B content and Si content with workability (remeltability).

An alloy composition range in which working was possible was studied, and it was found that remelting was performed by increasing B even if Si was decreased. The results are shown in FIG. 5.

A Ni-based thermal spraying alloy powder in which the amounts of B and Si were changed was made, and an alloy coating was formed on the surface of a boiler-heat exchanger carbon steel tube (STB 410) having an outer diameter of 48 6 mm and a wall thickness of 5 mm by flame spraying. Next, high frequency induction heating was performed from the substrate side to remelt the alloy coating. At this time, the treatment temperature was changed, and the temperature at which the coating began to melt, and the temperature at which the conversion of the coating into a liquid phase proceeded and the coating could not retain the shape and dripped were visually confirmed. It can be visually confirmed that when the coating begins to melt, the surface wets and smooths, and this is the lower limit of the working temperature range. When overheating is reached, the coating cannot retain the shape and drips, and therefore this is the upper limit of the working temperature range. When the working temperature range is narrow, treatment unevenness due to heating unevenness occurs to make working impossible, when the shape of an object to be treated is not a simple shape such as that of a steel tube, and therefore the working temperature range being the range of 50° C. or more is the criterion for determining whether working is possible or not. As a result, it was found that Si in an amount of at least 0.5% or more was necessary. Still more preferably, the relationship between Si and B satisfies $-0.25\ B+1.75Si \leq -0.25\ B+2.75$.

[Test 5]

Figure 6A:
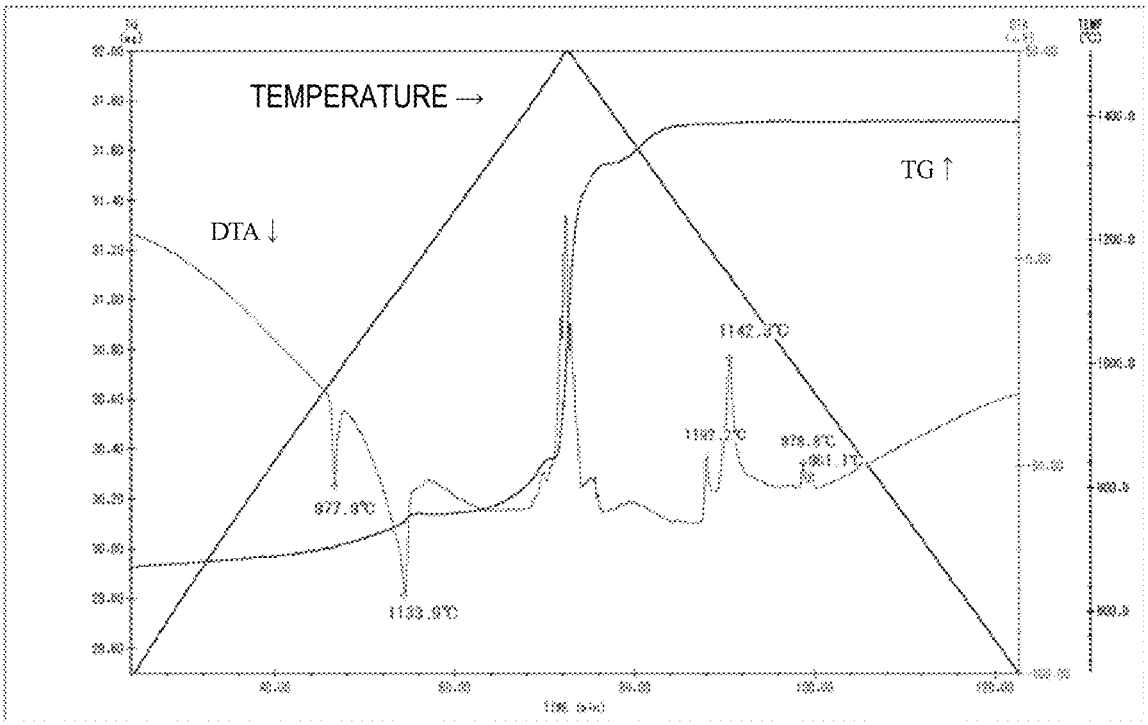
FIG. 6A is a graph showing the TG-DTA measurement results of the Ni-based thermal spraying alloy powder of the present invention.
Figure 6B:
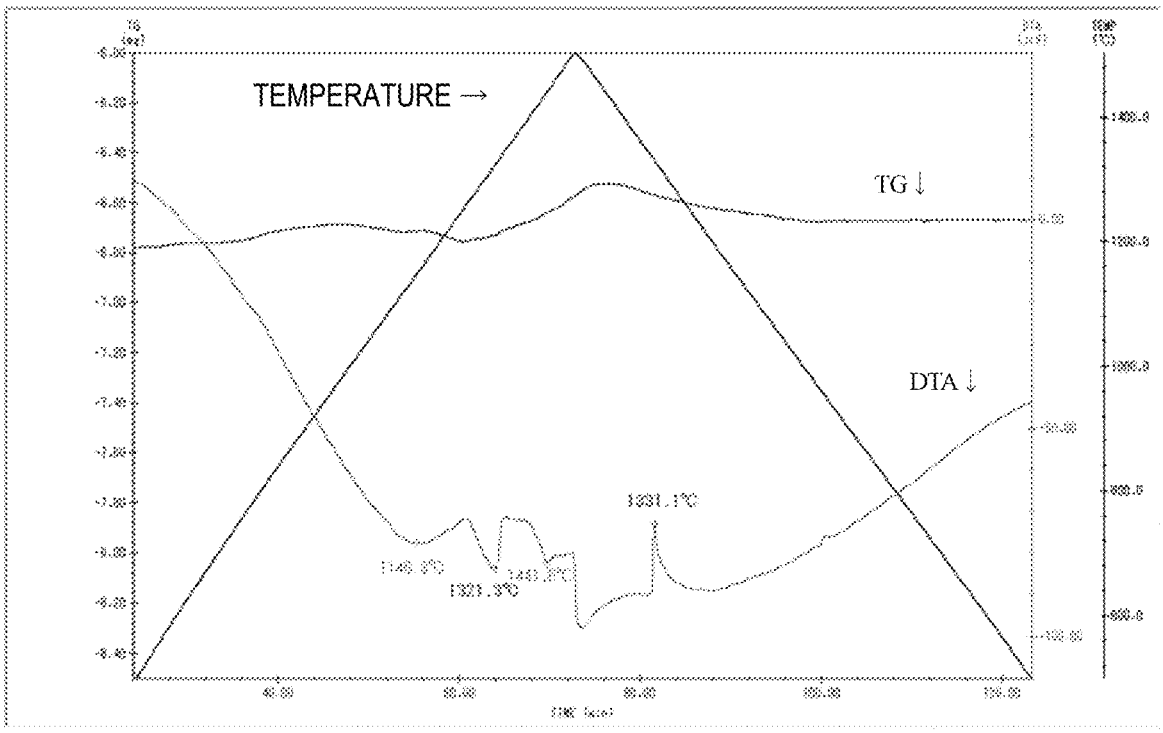
FIG. 6B is a graph showing the TG-DTA measurement results of a control alloy powder.

The results of the differential thermal analysis (the temperature is increased at 20° C/min to 1500° C., and cooling is performed at 20° C/min) of the Ni-based thermal spraying alloy of the present invention (No. 16 in Table 2) and an alloy in which the amounts of Si and B are outside the ranges of the present invention (comparative alloy; the amounts of Si and B of No. 16 are changed to 4 wt % and 0 wt % respectively) are shown in FIG. 6. From the Ni-based thermal spraying alloy of the present invention (FIG. 6A), from the DTA curve during temperature increase, it is found that at 977° C., a large endothermic peak is present, and melting begins. From the DTA curve during temperature decrease, it is found that at 1142° C., a large exothermic peak is present, and solidification begins. From the above, it can be deemed that the Ni-based thermal spraying alloy of the present invention has a melting start temperature of 1,000° C. or less, and a temperature range of 100° C. or more (165° C.) between the liquidus and the solidus. On the other hand, for the comparative alloy (FIG. 6B), an endothermic peak at 1321° C. is seen in the DTA curve during temperature increase, and an exothermic peak at 1331° C. is seen in the DTA curve during temperature decrease, and it is found that the melting start temperature greatly exceeds 1000° C., and the temperature range between the liquidus and the solidus is also small, 10° C.

[Test 6]

Ni-based thermal spraying alloy powders having the compositions shown in Table 2 were made, and evaluated by the same erosion-corrosion test and corrosion test as test 3.

TABLE 2

| Classification | Alloy number | Ni | Cr | Mo | Si | B | C | Fe | Amount of erosion-corrosion (μm) | Amount of corrosion (mg/cm$^2$) |
|---|---|---|---|---|---|---|---|---|---|---|
| Reference Example | No. 15 | Balance | 15 | 3 | 4 | 3 | 0.5 | 3 | 48.40 | 0.387 |
| Example 1 | No. 16 | Balance | 20 | 3 | 1 | 5 | 0.5 | 3 | 25.65 | 0.286 |
| Example 2 | No. 17 | Balance | 20 | 0.5 | 1 | 5 | 0.5 | 3 | 16.23 | 0.420 |
| Example 3 | No. 18 | Balance | 20 | 0.5 | 1.5 | 5 | 0.5 | 3 | 19.83 | 0.370 |
| Example 4 | No. 19 | Balance | 20 | 0.5 | 1.5 | 6 | 0.5 | 3 | 23.64 | 0.452 |
| Comparative Example 1 | No. 20 | Balance | 14 | 3 | 1 | 5 | 0.5 | 3 | 24.33 | 0.755 |
| Comparative Example 2 | No. 21 | Balance | 26 | 3 | 1 | 5 | 0.5 | 3 | 50.12 | 0.276 |
| Comparative Example 3 | No. 22 | Balance | 20 | 0.5 | 3 | 5 | 0.5 | 3 | 52.68 | 0.331 |
| Comparative Example 4 | No. 23 | Balance | 20 | 0.5 | 1 | 8 | 0.5 | 3 | 29.46 | 0.684 |

*The content of each element is expressed in wt %.

In all of Examples 1 to 4, the erosion-corrosion resistance is excellent, and the corrosion resistance is at a level equivalent to or higher than that of Reference Example (conventional product). In Comparative Example 1 in which the Cr content is low and Comparative Example 4 in which the B content is high, the erosion-corrosion resistance is equivalent to that of Examples 1 to 4, but the amount of corrosion is about twice as large, and the corrosion resistance is poor. In Comparative Example 2 in which the Cr content is high and Comparative Example 3 in which the Si content is high, the amount of erosion-corrosion is large, and the erosion-corrosion resistance is poor.

INDUSTRIAL APPLICABILITY

As described above, according to the present invention, a Ni-based thermal spraying alloy powder having corrosion resistance at the same or higher level than conventional products and being excellent in erosion-corrosion resistance, and a method for manufacturing an alloy coating are provided. In a fluidized bed boiler using a raw material comprising chlorine such as biomass as a fuel, by working a thermally sprayed coating on a heat transfer tube and the like using the Ni-based thermal spraying alloy powder of the present invention, the life extension of the apparatus can be promoted.

REFERENCE SIGNS LIST

1: fluidized bed test apparatus
2: container
3: electric furnace
4: fluidized bed
5: glass filter
6: test portion
7: test piece holder
8: cooling water conduit
S: test piece

The invention claimed is:

1. A Ni-based thermal spraying alloy powder consisting of Cr:

15 wt % or more and 25 wt % or less, Mo: 1 wt % or more-and 5 wt % or less, Si: 0.5 wt % or more and less than 2.0 wt %, Fe: 5 wt % or less, C: 0.3 wt % or more and 0.7 wt % or less, and B: more than 5 wt % and 7 wt % or less, with the balance being Ni and incidental impurities, and wherein contents of Si and B satisfy the relationship of $-0.25$ B (wt %)$+1.75 \leq$Si (wt %)$\leq -0.25$ B (wt %) $+2.75$ and wherein the thermal spraying alloy has a melting start temperature at 1,000° C. or less.

2. The Ni-based thermal spraying alloy powder of claim 1 wherein a temperature range between the liquidus and the solidus is approximately 100° C. or more.

3. A Ni-based thermal spraying alloy powder consisting of Cr: 15 wt % or more and 25 wt % or less, Mo: 1 wt % or more-and 5 wt % or less, Si: 0.5 wt % or more and less than 2.0 wt %, Fe: 5 wt % or less, C: 0.3 wt % or more and 0.7 wt % or less, and elemental B: more than 5 wt % and 7 wt % or less, with the balance being Ni and incidental impurities, and wherein contents of Si and B satisfy the relationship of $-0.25$ B (wt %)$+1.75 \leq$Si (wt %)$\leq -0.25$ B (wt %)$+2.75$.

4. The Ni-based thermal spraying alloy powder of claim 3 wherein the thermal spraying alloy has a melting start temperature at 1,000° C. or less.

5. The Ni-based thermal spraying alloy powder of claim 4 wherein a temperature range between the liquidus and the solidus is approximately 100° C. or more.

6. A method for manufacturing an alloy coating comprising thermally spraying the Ni-based thermal spraying alloy powder according to claim 1 onto a substrate to form an alloy coating, and remelting the alloy coating to reduce porosity in the alloy coating and improve adhesiveness between the alloy coating and the substrate.

7. The method for manufacturing the alloy coating according to claim 6, wherein the remelting is performed by high frequency induction heating.

* * * * *